United States Patent [19]

Duer

[11] Patent Number: 4,787,289

[45] Date of Patent: Nov. 29, 1988

[54] BULLET TRAP

[76] Inventor: Morris J. Duer, 8501 Peachwood Dr., Centerville, Ohio 45458-6642

[21] Appl. No.: 144,093

[22] Filed: Jan. 15, 1988

[51] Int. Cl.[4] ..... F41J 1/12

[52] U.S. Cl. ..... 89/36.02; 273/410

[58] Field of Search ..... 89/1.1, 36.02, 36.07; 273/410

[56] References Cited

U.S. PATENT DOCUMENTS

| | | | |
|---|---|---|---|
| 941,642 | 11/1909 | Maxim | 273/410 |
| 2,812,660 | 11/1957 | Marden et al. | 273/410 |
| 3,739,731 | 6/1973 | Tabor | 89/1.1 |
| 4,201,385 | 5/1980 | Szabados | 273/410 |

FOREIGN PATENT DOCUMENTS

| | | | |
|---|---|---|---|
| 3212781 | 10/1983 | Fed. Rep. of Germany | 273/410 |

OTHER PUBLICATIONS

Twin-Duty Target Box, "Popular Mechanics", p. 141, Jun. 1974.

IPN WO85/05672, Simonetti, Dec. 1985.

*Primary Examiner*—David H. Brown

*Attorney, Agent, or Firm*—Malcolm R. McKinnon

[57] ABSTRACT

An improved bullet trap effective to stop and retain bullets fired from a firearm and enabling the recovery of such bullets in a reuseable condition. The bullet trap includes an elongate tubular housing defining a chamber open at each end, and a pair of cover assemblies are provided which are releasably secured to the opposite end portions of the housing, the cover assemblies each including a membrane formed of a material easily penetrated by a bullet fired from a firearm. The chamber defined by the housing is loosely filled with a relatively low density filler material in the form of particles effective to stop and retain bullets fired therein without significant deformation of the bullets. The bullet trap also includes a basket incorporating an open mesh screen which enables removal of bullets from the trap without requiring removal of the filler material therefrom. In addition, the bullet trap includes adjustable leg means which facilitates positioning and supporting the bullet trap on the ground or other supporting surface.

10 Claims, 2 Drawing Sheets

BULLET TRAP

BRIEF SUMMARY OF THE INVENTION

This invention relates to bullet traps and, more particularly, to an improved bullet trap which is effective to stop and retain bullets fired from a firearm and which enables the recovery of such bullets in a reusable condition, the bullet trap being primarily intended for target shooting.

Heretofore, many bullet traps have been devised for the purpose of stopping and collecting bullets, such prior devices being primarily intended for use in collecting bullet material and minimizing ricochets. Bullets recovered from these prior devices are usually significantly deformed and not sufficiently close to their original design configuration to permit expeditious resizing and reloading. One example of such a prior art bullet trap is disclosed in U.S. Pat. No. 2,815,955 issued Dec. 10, 1957. In U.S. Pat. No. 2,815,955, the bullets strike an angled armor steel plate which tends to cause massive deformation of the bullets, and the bullets are then deflected into a sand trap from which they are recovered as a supply of metal. Another prior art bullet trap of the indicated character is disclosed in U.S. Pat. No. 941,642 issued Nov. 30, 1909 wherein a sandbox is provided forming a receptacle for sand. A mass of fibrous material is interposed between the sand and the front wall of the receptacle so that a bullet penetrating a target on the front wall of the receptacle passes through the layer of fibrous material and then into the sand from which the bullet material may then be recovered subject to the deformation caused by the bullet trap.

An object of the present invention is to overcome disadvantages in prior bullet traps of the indicated character and to provide an improved bullet trap incorporating improved means for stopping and retaining bullets fired from a firearm and which enables such bullets to be recovered in a reusable condition.

Another object of the present invention is to provide an improved bullet trap incorporating improved means for stopping and storing bullets in the same condition as fired from a firearm.

Another object of the present invention is to provide an improved bullet trap which enables the recovery of bullets and the restoration thereof to their original quality with a conventional bullet swaging die.

Another object of the present invention is to provide an improved bullet trap incorporating improved means for stopping and capturing bullets without significant deformation of the bullets.

Another object of the present invention is to provide an improved lightweight, portable bullet trap which utilizes a relatively low density particulate material to stop and capture bullets without significant deformation of the bullets.

Another object of the present invention is to provide an improved bullet trap incorporating improved means for containing and retaining the material which stops and stores the bullets.

Another object of the present invention is to provide an improved bullet trap which permits entry of bullets into the trap but which does not allow the material that stops the bullets to leak through bullet holes formed when the bullets enter the trap.

Another object of the present invention is to provide an improved bullet trap incorporating improved means for segregating accurately fired bullets from bullets conventionally known as "fliers".

Still another object of the present invention is to provide an improved bullet trap that is economical to manufacture and assemble, durable, efficient and reliable in operation.

The above as well as other objects and advantages of the present invention will become apparent from the following description, the appended claims and the accompanying drawings.

DETAILED DESCRIPTION

Figure 1:
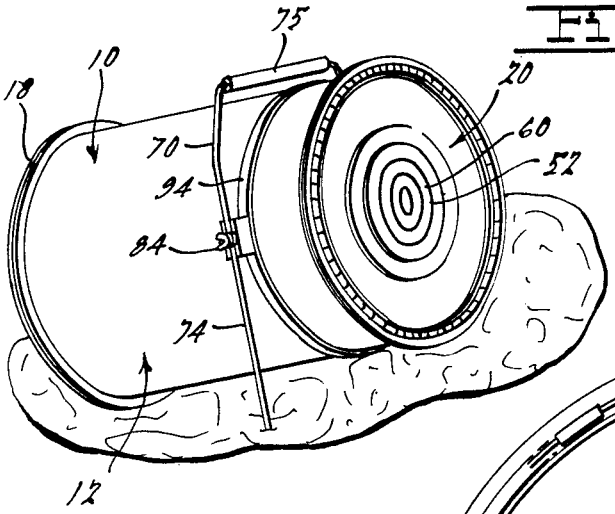
FIG. 1 is a perspective view of a bullet trap embodying the present invention.
Figure 3:
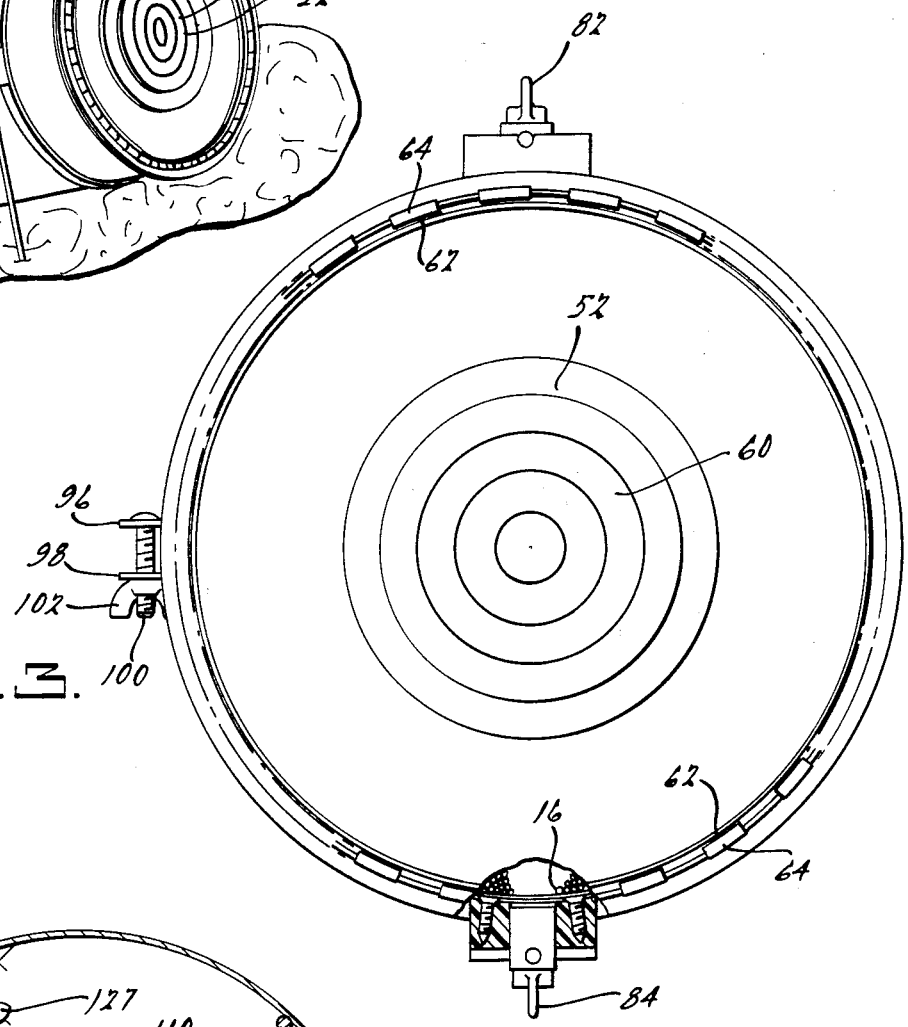
FIG. 3 is an end elevational view, with portions broken away, of the bullet trap illustrated in FIG. 1.

In general, bullet traps embodying the present invention are effective to stop and retain bullets fired therein and enable the recovery of such bullets in a reusable condition. While bullet traps embodying the present invention are intended primarily for target shooting, it will be understood that the present invention is also applicable to other uses. Bullet traps embodying the present invention include a tubular housing which holds material that stops and stores the bullets in the same condition as they are in when they emerge from the firearm. The recovered bullets may then be restored to their original quality with a conventional bullet swaging die.

The filler material contained within the tubular housing of the bullet trap may be referred to as having limited fluid characteristics, and the frictional characteristics of the material should be such as to permit the material to flow freely so as to refill the channel created by a previously fired shot. The material should also flow freely enough to allow the retained bullets to be screened from the retaining material, and the limiting fluid characteristics should be such as to prevent leakage of the material through the bullet holes resulting from bullets entering the bullet trap. The entire mass of the filler material must move freely enough to allow the spent bullets to move gradually to the rear of the bullet trap so as to avoid damaging contact with incoming bullets. The density of the filler material should be such as to stop the incoming bullets in a reasonable distance without bullet deformation or damage, it being understood that the greater the density of the filler material, the quicker the bullets will stop. It will also be understood that if the bullets are stopped too quickly, the stresses encountered will cause undesirable distortion or deformation of the bullets. In addition, the durability characteristics of the filler material must be adequate to take shot after shot without change such as powdering or packing, and the filler material must also maintain its density and frictional characteristics. It has been found that a material that meets all of the above requirements is identified as polypropylene, Grade 6014, marketed by the Plastics Division of the Amoco Chemicals Corporation, 130 East Randolph Drive, Chicago, Ill. 60601. Such material is marketed in the form of small plastic particles referred to as a medium-flow injection molding copolymer, and may be utilized in the form as marketed. Characteristics of these particles are as follows:

Angle of repose—32 degrees from horizontal 37 pounds per cubic foot in particle form Particle size—0.150 inches diameter X 0.075 inches thick Particle weight—0.32 grains Avoirdupois It will be understood that other materials having relatively similar characteristics may be utilized.

Bullet traps embodying the present invention serve a number of functions. For example, bullet traps embodying the present invention contain and retain the material that stops and retains the bullets, such as Amoco Polypropylene Grade 6014. The bullet traps also allow the bullets to enter the bullet traps as they are fired from a firearm, but the bullet traps do not allow the material that stops the bullets to leak through the bullet holes that are formed as the bullets enter the traps. The magnitude of this problem is readily apparent when one observes that the bullet size is many times larger than the particle size. It should also be understood that the entrance holes made in the entrance to the bullet trap by the fast moving bullets are much smaller than the bullets and are also quite jagged. The resulting condition is very resistant to exit flow of the small plastic particles. In bullet traps embodying the present invention, a sectionalized, double membrane principle is utilized in the end cover assemblies, the end cover assemblies being identical on both ends of the tubular housing. It has been found, for example, that a four inch target circle will easily accommodate one hundred shots before the sectionalized, central section of the cover assembly must be replaced.

In normal usage, the filler material is not removed from the associated bullet trap. On the other hand, the bullets are removed from the trap by a screen assembly which will be described hereinafter in greater detail, the screen assembly being reversible whereby it may be operated from either end of the bullet trap. Shooting is always done from the end of the bullet trap opposite the screen location, and the bullets are removed from the trap by first removing an end cover assembly and then moving the screen assembly through the filler material contained within the bullet trap. After the bullets have been removed from the screen assembly, the screen assembly may be reversed and the cover assembly replaced and shooting can then proceed from the opposite end of the bullet trap.

Bullets traps embodying the present invention are equipped with a bail which facilitates transportation of the bullet trap and which is also used for holding the bullet trap in the desired position for the shooter's convenience, it being understood that shooting must be done in a direction parallel to the center line of the tubular housing of the bullet trap.

As previously mentioned, bullet traps embodying the present invention permit the recovery of bullets in a reusable form. However, it must be understood what type of bullets are referred to and their respective velocities. Target shooting with handguns in the past has usually involved a so called wad-cutter bullet fired at relatively low velocity. With the advent of silhouette shooting, the type and velocity of bullets has vastly changed. An example of a bullet suitable for use in bullet traps embodying the present invention may be identified as Remington 9 millimeter, 124 gr. full metal case no. B22842. Such bullets may, for example, be reswaged to 0.357 diameter for shooting in 357 Magnum handguns. In actual tests, such bullets have been reswaged and shot more than twenty five times without any indication of bullet failure when such bullets are fired at the same loading and velocity.

Bullets may be recovered from traps embodying the present invention in the same condition as they were when they emerged from the firearm. While it has been found that a small amount of plastic residue and burned powder may be present on the recovered bullets, such plastic residue and burned powder may be easily removed by tumbling, although reswaging without cleaning does not appear to result in any significant difference. As a result of firing, it has been found that the length of the bullet increases approximately five and one half percent while the diameter of the bullet is reduced in proportion. The surface of a bullet recovered from a bullet trap embodying the present invention appears to show all the engraving from the gun barrel. Reswaging requires very little effort or time. The recovered bullets. being undersized, enter the swaging die quite readily, and if the press is equipped with an automatic expeller, twenty bullets per minute can easily be processed.

The maximum velocity recommended for full metal case bullets fired into bullet traps embodying the present invention is fifteen hundred feet per second if the trap has a length of approximately twenty eight inches. For bullets fired at a velocity of not over one thousand feet per second, bullet traps may have a length of approximately seventeen inches.

Referring to the drawings, a bullet trap, generally designated 10, embodying the present invention is illustrated therein and is comprised of a tubular housing, generally designated 12, that defines a chamber 14 which is open at each end and which is adapted to receive the filler material 16, as will be described hereinafter in greater detail. The housing 12 may be made of metal, plastic or any other suitable material having sufficient strength to withstand the forces exerted thereon. A pair of sectionalized cover assemblies, generally designated 18 and 20, are provided which are releasably secured to the opposite end portions 22 and 24, respectively, of the housing 12. The sectionalized cover assemblies 18 and 20 are identical in construction and are each comprised of an annular section 26 and a central section 28 releasably secured to the annular section 26 as will be described hereinafter in greater detail. The annular section 26 of each of the cover assemblies 18 and 20 is comprised of a pair of ring-like membranes 30 and 32 each of which includes a radially extending web portion 34, an integral circumferentially disposed flange portion 36 integrally joined to a radially disposed flange portion 38, and a circumferentially extending flange portion 40 disposed radially outwardly of the radially inner end 42 of the web portion 34 and the free end 44 of which is disposed in spaced relationship with respect to the free end 44A of the corresponding flange portion 40A of the membrane 30 so as to define a slot 46 therebetween. The central section 28 of each of the cover assemblies includes a pair of generally hat shaped membranes 48 and 50 each of which includes a radially disposed web portion 52 having side walls 54 and 56 and a radially disposed brim portion 58 which extends through the slot 46 defined by the flange portions 44 and 44A so as to releasably secure the central section 28 to the annular section 26 of the associated cover assembly 18 or 20. The cover assemblies 18 and 20 are preferably formed of polyethylene, and the web portions 48 and 50 of the central section 28 extend radially in spaced relationship with respect to each other, as for example, one half inch apart, so that the web portions 48 and 50 retain the filler material 16 in the housing when bullets are shot through the cover assemblies. As will be understood by those skilled in the art, the entrance holes made in the cover assemblies 18 and 20 by a fast moving bullet are much smaller than the bullet and are also quite jagged. The resulting condition is very resistant to exit flow of the small plastic particles forming the retaining material 16. Thus, the cover assemblies 18 and 20 are easily penetrable by a bullet from a hand held firearm without significant deformation of the bullet, and it has been found that the use of polyethylene material for the cover assemblies 18 and 20 will provide good results in the practice of this invention. It will be appreciated that suitable targets, such as self adhesive targets 60, may be affixed to the outer surfaces of the web portion 52 at each end of the bullet trap for target shooting purposes.

Figure 2:
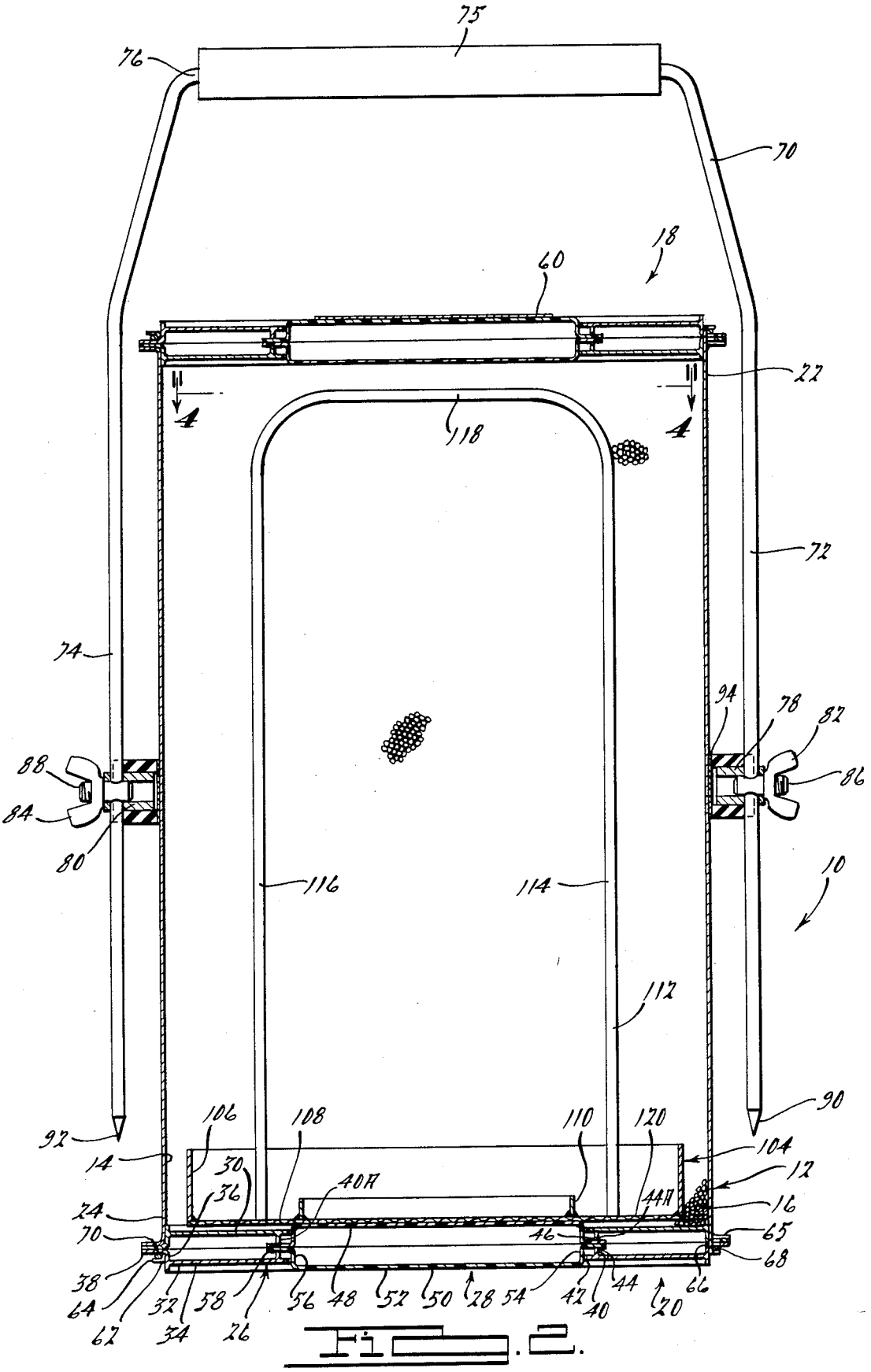
FIG. 2 is a longitudinal cross sectional view of the bullet trap illustrated in FIG. 1.

The cover assemblies 18 and 20 are releasably secured to the housing through the agency of a plurality of angularly spaced, generally L-shaped flanges 62 which are provided on each end portion of the housing 12, the flanges 62 having radially outwardly projecting tab portions 64 which are adapted to pass through elongate slots 66 formed around the entire periphery of each of the membranes 30 and 32. The slots 66 have a length and width approximately equal to the length and width of the tab portions 64 so that when the cover assemblies are placed over the peripheral flanges 65 provided on the housing as illustrated in FIG. 2, the tab portions 64 project through the slots 66 provided in the membranes 30 and 32 and overlie the flanges 38 of the membranes 32. Thereafter, an elastic band 68, such as a conventional shock cord, is stretched so as to slip over the peripheral row of tabs and be disposed in the spaced 70 between the inner surface of the tabs and the outer surface of the flange 38 and elastically grip the periphery of the membranes 32 to retain the cover assemblies in place. It will be understood that the cover assemblies may be easily and quickly removed from the housing by disengaging the elastic band 68 from the flanges 64 and then removing the annular section 26 and the central section 28. It will be understood that the central section will need to be replaced more frequently than the annular section because most of the shots fired into the bullet trap will penetrate the central section rather than the annular section if the shooter is reasonably proficient.

The housing 12 is adapted to be supported through the agency of a generally U-shaped bail member 70 having spaced substantially parallel leg portions 72 and 74 integrally joined by a bight portion 76, a tubular hand grip 75 being circumposed on the bight portion 76. The leg portions 72 and 74 are adapted to pass through trunnion members 78 and 80 and are fixed therein by wing nuts 82 and 84 threadably engaging screw members 86 and 88, respectively. Loosening of the wing nuts 82 and 84 permits the leg portions 72 and 74 of the bail member 70 to be longitudinally slideably positioned in the trunnions and to be pivoted so that the sharpened ends 90 and 92 of the leg portions project angularly away from the housing, and the bail member 70 supports the housing 12 in any desired angular position relative to the ground or other supporting surface. The trunnions 78 and 80 in turn are carried by a circular band 94 which is circumposed on the housing 12 and which is provided with outwardly projecting flanges 96 and 98 adapted to receive a clamping screw 100 and associated wing nut 102 which function to clamp the band 94 to the periphery of the housing 12 at any desired position longitudinally of the housing. Thus the bail member 70 is adjustable longitudinally of the housing and is also adjustable angularly relative to the longitudinal axis of the housing.

In the practice of the invention, the bullet trap 10 is positioned on the ground or other supporting surface as illustrated in FIG. 1 whereby the leg portions 72 and 74 of the bail member 70 are adjusted to support one end of the housing above the level of the surface of the ground or other support. The user then stands at the desired distance from the bullet trap facing the raised end thereof and discharges a firearm, for example a handgun, in the direction of the target, such as the concentric circle target 60, fixed to the outer surface of the web portion 52 on the raised end of the housing. The bullet from the firearm penetrates the cover assembly and moves into the chamber 14 defined by the housing whereupon the filler material 16 stops and retains the bullet in a reusable condition in the manner previously described.

Figure 4:
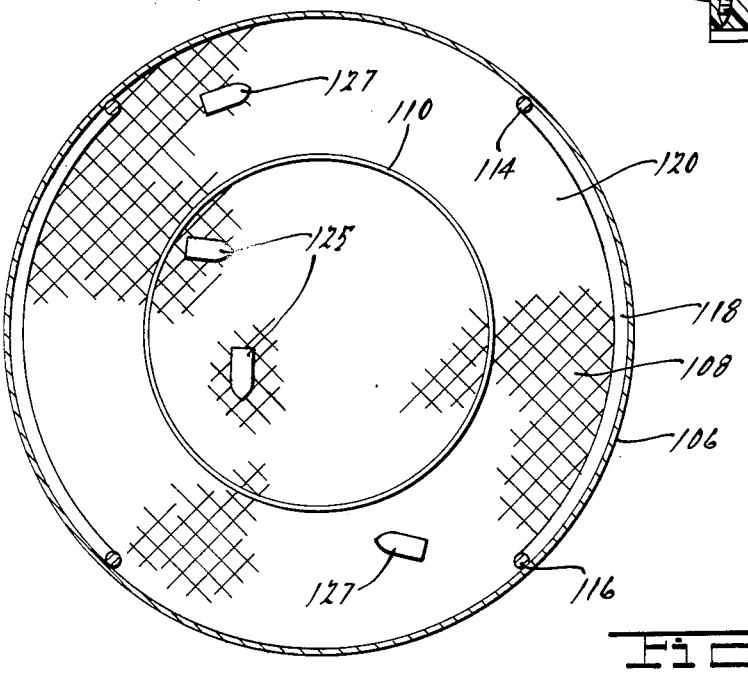
FIG. 4 is a cross sectional view of a portion of the structure illustrated in FIG. 2, taken on the line 4—4 thereof.

The bullet trap 10 also includes means to facilitate removal of the bullets from the housing, such means including a basket member 104 the components of which may be formed of metal, plastic or other suitable material having sufficient strength to withstand the forces exerted thereon. The basket member 104 is comprised of an open ended, relatively short cylindrical ring 106 is concentrically positioned in the housing. One end of the cylindrical ring 106 is covered with a planar screen member 108 having a mesh size significantly greater than the size of the particles of the filler material but less than the minimum diameters of the bullets. An additional concentric cylindrical wall or ring 110 is positioned in concentric relationship with respect to the ring 106 and attached to the surface of the screen 108 whereby the ring 110 is disposed within the ring 106. Attached to the ring 106 of the basket member on opposite sides thereof are a pair of diametrically opposite handle members such as 112 each of which include a pair of spaced elongate leg portions 114 and 116 integrally joined by a bight portion 118. With the basket member positioned in the housing as illustrated in FIGS. 2 and 4, the handle members extend longitudinally of the housing through the particles 16. When it is desired to remove the trapped bullets from the bullet trap, the bullet trap is placed on end and the upper cover assembly is removed from the housing in the manner previously described. The basket member 104 is then lifted through the filler material 16 through the agency of the handle members 112. The combination of the open mesh of the screen 108 together with the fluid like characteristics of the particles 16 permits the particles to flow through the screen 108 as the screen moves axially through the housing 12. The bullets, however, are retained by the screen 108. Thus, upon removal of the screen from the housing, the screen contains the previously trapped bullets. Moreover, those bullets, such as the bullets 125, which penetrated the filler material near the axis of the housing will be found within the inner ring 110 of the basket member while those bullets, such as the bullets 127, which penetrated the target at positions more radially remote from the longitudinally axis of the housing will be collected in the annular space 120 between the inner ring 110 and outer ring 106 of the basket member 104. The more accurately fired bullets are thus segregated from bullets commonly known as "fliers". A choice may thus be made to reload only the more accurately fired bullets collected from within the ring 110.

It is an advantageous feature of the present invention that a fresh target may be exposed by merely reversing the position of the bullet trap from the position shown in FIG. 1, so that the end of the housing to which the cover assembly 18 is attached is raised and exposed to the user. It will be understood that the basket member 104 will need to be reversed in order to collect bullets penetrating the cover assembly 18.

From the foregoing it will be appreciated that the present invention provides a bullet trap capable of stopping bullets in flight without significant permanent bullet deformation, and the bullet trap is also capable of collecting the bullets in groups for expeditious retrieval and reuse. Sudden expansion forces caused by a penetrating bullet are absorbed by movement of the particles 16 against each other and permissible shifting or light packing of masses of particles in the chamber 14 defined by the housing 12. While the housing 12 is illustrated as being right circular in cross-section, it will be understood that housings of other configurations may be employed. The mass of polypropylene particles enclosed in the housing have a unique characteristic of acting upon a penetrating bullet in the manner of a very viscous fluid. Most of the energy in the penetrating bullet is absorbed in the first few inches of travel of the bullet into the particle mass. The filler material can best be referred to as a semi fluid or as having a limited fluid characteristic. the frictional characteristics permit the filler material to flow freely to refill the channel from the previous shot. The filler material also flows freely enough to allow the retained bullets to be screened from the retaining medium. It is preferred that the limiting fluid characteristics be such as to prevent leakage of the medium through the bullet holes resulting from the bullets entering the trap. However, the entire mass of the filler material must move freely enough to allow the spent bullets to move gradually to the back of the trap to avoid damaging contacts with incoming bullets. It is preferred that the density characteristic be such as to stop the bullet in a reasonable distance without bulled deformation or damage. It will be understood that the greater the medium density, the quicker the bullet will stop. However, if the bullet is stopped too quickly, the stresses encountered will cause undesirable distortion or permanent deformation of the bullet. The durability characteristics of the medium should be adequate to take shot after shot without any substantial change such as powdering or packing. The medium must also maintain its density and frictional characteristics.

From the foregoing it will be appreciated that bullet traps embodying the present invention contain and retain the material which stops and stores the bullets. At the same time, bullet traps embodying the present invention allow the bullets to enter the bullet traps but do not allow the material that stops the bullets to leak out of the bullet traps through the bullet holes. It will also be appreciated that in normal usage, the filler material, such as Amoco propylene Grade 6014, is not removed from the bullet trap. The bullets are removed from the trap by the screened basket, the basket being reversible and operable from either end of the bullet trap. Shooting, of course, must always be done from the end opposite the screen location. The bullets are then removed by removing the end cover assembly through which the bullets were shot and pulling gently on the basket handles which extend the length of the trap. The bullets are then removed from the basket, the basket reversed, and the cover replaced. Shooting can then proceed from the opposite end of the bullet trap. The maximum velocity recommended for full metal case bullets fried into bullet traps as above described is fifteen hundred feet per second.

While a preferred embodiment of the invention has been illustrated and described, it will be understood that various changes in modifications may be made without departing from the spirit of the invention.

What is claimed is:

1. A bullet trap comprising, in combination, a tubular housing defining a chamber open at each end of said housing, a pair of cover assemblies, one of said cover assemblies being releasably secured to one end portion of said housing and the other of said cover assemblies being secured to the opposite end portion of said housing, each of said cover assemblies including a membrane formed of a material easily penetrated by a bullet fired from a firearm, and a relatively low density filler material in the form of particles loosely filling the chamber defined by said housing and being retained therein by said cover assemblies.

2. The combination as set forth in claim 1 wherein said filler material is a synthetic resin material.

3. The combination as set forth in claim 1, wherein said filler material is a copolymer.

4. The combination as set forth in claim 1 wherein said filler material is polypropylene.

5. The combination as set forth in claim 1 wherein said filler material has an average diameter of 0.15 inches and a density in particle form of approximately thirty four pounds per cubic foot.

6. A bullet trap comprising, in combination, a tubular housing defining a chamber open at each end, a pair of cover assemblies, one of said cover assemblies being removably secured to one end of said housing and the other of said cover assemblies being removably secured to the opposite end of said housing, a mass of relatively small polypropylene resin beads loosely filling the chamber defined by said housing, each of said cover assemblies including a centrally disposed membrane formed of polyethylene and easily penetated by a bullet fired from a firearm, and bail means attached to said housing, said bail means including a pair of spaced substantially parallel leg portions integrally joined by a bight portion, said leg portions of said bail means being pivotally connected to said housing on opposite sides thereof, said bail means being adapted to be rotated transversally about said housing whereby said leg portions project outwardly away from said housing in angular relationship with respect to the longitudinal axis of said housing, said leg portions providing in combination with one end portion of said housing a three point support system effective to support said housing on a generally horizonal surface with said one end of said housing resting on said surface and the other end thereof raised in spaced relationship with respect to said surface.

7. The combination as set forth in claim 6 including basket means disposed in the chamber defined by said housing, said basket means including screen means effective to separate a bullet from said filler material when said basket means is moved longitudinally in said housing through said filler material.

8. A bullet trap comprising, in combination, a generally tubular housing defining chamber open at each end, a pair of cover assemblies, one of said cover assemblies being releasably secured to one end portion of said housing and the other of said cover assemblies being releasably secured to the opposite end portion of said housing, a mass of relatively small polypropylene resin beads loosely filling the chamber defined by said housing, each of said cover assemblies being formed of a material easily penetated by a bullet fired from a firearm without causing significant bullet deformation, bail means pivotally connected to said housing, said bail means comprising a generally U-shaped structure formed from relatively small diameter rod material, said housing having trunnion means attached thereto at diametrically opposite sides thereof and intermediate the ends of said housing, each leg of said U-shaped bail means at an intermediate area on the length of said legs being attached to a respective trunnion means whereby said legs are disposed in parallel relationship on opposite sides of said housing, said bail means being adapted to be rotated transversally about said housing so as to provide in combination with one end portion of said housing a three point support system effective to support said housing on a generally horizontal surface with said one end portion of said housing resting on said surface and the other end portion of said housing being raised into spaced relationship with respect to said surface.

9. The combination as set forth in claim 8 wherein said bullet trap includes bullet gathering means disposed in the chamber defined by said housing, said bullet gathering means comprising a first cylindrical wall member open at each end, an open mesh planar screen attached to one end of said wall member, the mesh size of said screen being significantly larger than the diameter of the resin beads in the chamber defined by said housing, handle means fixed to said cylindrical wall member and projecting longitudinally from one end therof whereby said wall member and said screen may be moved manually through the chamber defined by said housing when one of said cover assemblies is removed from said housing, and an additional circular retaining member having a diameter less than the diameter of said wall member and positioned concentrically therein and attached to said screen, said wall member and said retaining member defining in combination with said screen a pair of bullet collecting recesses including a central cylindrical recess and an annular recess concentric therewith.

10. The combination as set forth in claim 9 wherein each of said cover assemblies comprises a pair of flexible synthetic resin material membranes the central portions of which are positioned in spaced relationship with respect to each other, means maintaining the central portions of said membranes in spaced relationship over the enclosed area of said ring and between the periphery of said ring and the periphery of said membranes, the peripheral portions of said cover assemblies each defining a plurality of apertures, the adjacent end portions of said housing having a plurality of flanges adapted to be received in the apertures defined by said cover assemblies, and resilient means encompassing said flanges and bearing against an adjacent cover assembly to releasably secure said cover assembly to said housing.

* * * * *